US010315088B2

(12) United States Patent
Hall

(10) Patent No.: US 10,315,088 B2
(45) Date of Patent: Jun. 11, 2019

(54) TRAINING DEVICE FOR HABIT FORMATION LIMITING ARM MOVEMENT OVER A PREDETERMINED RANGE OF MOTIONS

(71) Applicant: Christopher T. Hall, Louisville, KY (US)

(72) Inventor: Christopher T. Hall, Louisville, KY (US)

( * ) Notice: Subject to any disclaimer, the term of this patent is extended or adjusted under 35 U.S.C. 154(b) by 0 days.

(21) Appl. No.: 14/544,721

(22) Filed: Feb. 9, 2015

(65) Prior Publication Data

US 2015/0224382 A1 Aug. 13, 2015

Related U.S. Application Data

(60) Provisional application No. 61/965,769, filed on Feb. 7, 2014.

(51) Int. Cl.

*A63B 69/00* (2006.01)
*A63B 69/38* (2006.01)
*A63B 102/32* (2015.01)

(52) U.S. Cl.

CPC ..... *A63B 69/0059* (2013.01); *A63B 69/002* (2013.01); *A63B 69/0002* (2013.01); *A63B 69/0071* (2013.01); *A63B 69/38* (2013.01); *A63B 2102/32* (2015.10); *A63B 2209/10* (2013.01)

(58) Field of Classification Search

CPC . A63B 69/0059; A63B 69/0002; A63B 69/38; A63B 69/002; A63B 69/0071; A63B 2102/32; A63B 2209/10

USPC ..... 473/450

See application file for complete search history.

(56) References Cited

U.S. PATENT DOCUMENTS 2,932,514 A * 4/1960 Bergmark ..... A63B 47/00 473/553
4,432,477 A * 2/1984 Haidt ..... A45F 5/00 224/222
4,500,019 A * 2/1985 Curley, Jr. ..... A45F 5/00 224/222
4,913,326 A * 4/1990 Echelson ..... A45F 5/00 224/222
5,167,598 A * 12/1992 Sands ..... A63B 69/0028 482/148

(Continued)

*Primary Examiner* — Eugene L Kim
*Assistant Examiner* — Jeffrey S Vanderveen
(74) *Attorney, Agent, or Firm* — David W. Carrithers; Carrithers Law Office, PLLC

(57) ABSTRACT

A training device for limiting limb movement over a predetermined range of motion providing habit formation for activities such as sports requiring memory of arm or leg movement. The device includes a resilient spacer means such as a block or ball disposed within a pocket in a strap which fits snugly around the players forearm. The spacer means and pocket are oriented in a position to permit limited pivotal movement of the elbow to an angle of about 90 degrees whereby the spacer contacts the forearm and upper arm. The elbow is prevented from pivoting beyond the point at which the forearm forms a selected angle with the upper arm. The strap is adjusted by a user to restrict the angle to which the elbow can be bent on the backward movement of the arm. Forward movement of the arm during a shot is not restricted.

12 Claims, 7 Drawing Sheets

(56) References Cited

U.S. PATENT DOCUMENTS

| | | | | | |
|---|---|---|---|---|---|
| 5,234,214 | A * | 8/1993 | Sexton | A63B 47/001 | 473/573 |
| D353,860 | S | 12/1994 | Walk | | |
| 5,503,316 | A * | 4/1996 | Stewart | B60R 7/14 | 224/312 |
| 5,544,877 | A | 8/1996 | Brownell | | |
| 5,651,743 | A | 7/1997 | Stpehan | | |
| 5,769,743 | A | 6/1998 | Stephan | | |
| 5,855,307 | A * | 1/1999 | Biddick | A45F 5/00 | 128/205.22 |
| 5,865,695 | A | 2/1999 | Mahala | | |
| 6,095,936 | A | 8/2000 | Kirkpatrick | | |
| 6,203,453 | B1 | 3/2001 | Coddens | | |
| 6,283,877 | B1 | 9/2001 | Cook | | |
| 7,172,522 | B1 | 2/2007 | Harvey | | |
| 7,771,293 | B1 | 8/2010 | Vann | | |
| 8,052,546 | B1 | 11/2011 | Nagel | | |
| D675,011 | S * | 1/2013 | Stiefel | D3/215 | |
| 2004/0106889 | A1* | 6/2004 | Robinson | A61F 5/0118 | 602/64 |
| 2007/0170189 | A1* | 7/2007 | Carlile | A45F 5/02 | 220/739 |
| 2009/0253527 | A1* | 10/2009 | Abraham | A63B 69/0028 | 473/214 |
| 2013/0304113 | A1* | 11/2013 | Eikman | A61B 17/1322 | 606/203 |
| 2015/0157914 | A1* | 6/2015 | Magstadt | A63B 69/0071 | 473/450 |
| 2015/0224382 | A1* | 8/2015 | Hall | A63B 69/0059 | 473/450 |

* cited by examiner

TRAINING DEVICE FOR HABIT FORMATION LIMITING ARM MOVEMENT OVER A PREDETERMINED RANGE OF MOTIONS

CROSS REFERENCE TO RELATED APPLICATIONS

This application claims priority from U.S. Provisional Application Ser. No. 61/965,769 filed on Feb. 7, 2014 which is incorporated herein in its entirety.

TECHNICAL FIELD

The present invention relates to the field of training devices for habit formation limiting arm or leg movement over a predetermined range of motion, and more particularly as applied to sports such as a basketball shooting or dibbling training aid, soccer, baseball, tennis, or golf.

BACKGROUND OF THE INVENTION

Basketball is a common sport played by youths and adults the world over and especially in the United States. Most people learn the game from other friends without the help of a coach or a trainer. Consequently, bad habits and poor techniques are picked up. As with any activity or sport, the longer and more often a person uses bad technique, the harder it is to learn good habits.

Players need to learn proper technique and need to know when they are using proper technique and when they are not. Especially where shooting is concerned, players need to learn all the fine points of shooting since small mistakes can have the worst consequences. Therefore, players need a reminder of good technique before or during every shot until the proper technique becomes a habit. Repeated practice of the proper techniques is necessary.

When proper technique is used over and over, the correct group of muscles and nerves develop and work together to shoot the ball correctly creating consistency and reproducible results. With repeated practice, the muscles are exercised and are thus strengthened. The nerves, muscles, and mind all work together to make good technique a learned skill. This is referred to as 'neuromuscular memory'.

Proper positioning of the hands, arms, shoulders and body before a shot are critical and are also part of good form and proper technique, as well.

In a preferred method for executing a one hand push shot, the opposite hand is used as a pre-release stabilizer or guide and the forearm of the shooting arm is kept parallel to the center line of the body during the shooting motion. The centerline of the body is an imaginary line dividing the player vertically down the middle of his or her body. When the forearm of the shooting is not aligned with the centerline when shooting, the basketball has the tendency to stray from its proper shooting trajectory. This tendency causes a decrease in the percentage of shots that fall through the hoop.

DESCRIPTION OF THE RELATED ART

U.S. Pat. No. 5,769,743 by Stephen et al for BASKETBALL PRACTICE AID which issued on Jun. 23, 1998 teaches a brace which includes a form fitting right angle bracket which is held on either the upper arm or the forearm near the inside of the elbow by a strap with some sort of fastener such as hook and loop material. The arm can freely move and bend at any position where the angle formed by the forearm and upper arm is greater than 90 degrees.

U.S. Pat. No. 5,865,695 by Mahal et al for TRAINING DEVICE FOR BASKETBALL PLAYERS FOR DEVELOPING PROPER SHOOTING TECHNIQUE which issued on Feb. 2, 1999 teaches two hinged brackets which are strapped on both sides of a player's primary shooting arm at the forearm and the upper arm. The hinges are located coaxially with the elbow. The hinged brackets include a stop in the hinges which prevent the brackets and thus the player's arm from bending to any angle less than 90 degrees.

SUMMARY OF THE INVENTION

A training device for limiting limb movement over a predetermined range of motion providing habit formation for activities such as sports requiring memory of arm or leg movement. to shoot or dribble a ball, kick a ball, swing a bat, a racket, or a golf club. Upon application to the sport of basketball, the training device can be used to initiate and develop proper shooting technique for basketball players. The device includes a resilient spacer means such as a block or ball disposed within a pocket in a strap which fits snugly around the players forearm and upper arm. The spacer means and pocket are oriented in a position to permit limited pivotal movement of the elbow which is prevented from pivoting beyond the point at which the forearm forms a selected angle with the upper arm. The forearm is allowed pivot with respect to the upper arm over a predetermined range of motion whereby the forearm is prevented from pivoting beyond the point at which it forms a selected angle with the upper arm. The strap is adjusted by a user to restrict the angle to which the elbow can be bent on the backward movement of the arm to about 90 degrees; however, forward movement of the arm during a shot is not restricted.

In accordance with the present invention, there is provided a basketball shooting training aid comprising, consisting of, or consisting essentially of an attachment strap, a pocket strap, and a blocking device. The attachment strap includes a buckle at a first end and hook and loop material on the top side thereof at a second end. The attachment strap comprises non-stretchable material and is in the range of 12 to 20 inches long and in the range of one to three inches wide. The attachment strap has about a one and one-half inch length of hook material at the second end of the strap and loop material covering the top side of the attachment strap from about one and one-half inches from the second end to about seven inches from the first end of the attachment strap. The pocket strap is fixedly attached to the top surface of the attachment strap at a position between a point about two and one half inches from the first end of the attachment strap to a point about seven inches from the first end of the attachment strap. The pocket strap is in the range of two to four inches wide, in the range of ten to twelve inches long and is perpendicular to the attachment strap. The pocket strap has hook material on the top surface near a first end thereof and loop material on the bottom surface near a second end thereof. The blocking device is held within the pocket strap and is preferably a resilient ball such as a tennis ball.

It is an object of this invention to provide a basketball shooting training aid which causes a player to position his forearm arm in the correct angle relative to the upper arm by providing a positive stop which prevents the arm from bending at less than a 90° angle.

It is an object of this invention to provide a basketball shooting training aid which remains in position on a player's arm as constant reminder during every shot to maintain proper form.

It is an object of this invention to provide a basketball shooting training aid which is adjustable for any size forearm.

It is an object of this invention to provide a basketball shooting training aid which has a pocket which firmly holds a selected object which acts as a barrier to prevent the bending of the shooting arm to less than a selected angle.

It is an object of this invention to provide a basketball shooting training aid which is comfortable to wear and light-weight.

It is an object of the present invention to control the relative position between the upper arm and forearm of the shooting arm of a user;

It is an object of the present invention to restricts the bending of the elbow of the shooting arm to an angle of 90 degrees between the upper arm and the forearm.

It is an object of the present invention to provide a spacer means comprising a hollow or solid: bladder, ball, egg or ovoid shaped member, cube, square, roll, or other compressible spacer means.

It is an object of the present invention to provide a strap comprised of a flexible but longitudinally unyielding material comprises of leather, neoprene, a woven synthetic material, a neoprene or foam rubber material between sandwiched between thin sheets of tougher material such as nylon or lycra/spandex material ranging from 1 mm to 8 mm in thickness, and combinations thereof.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided a training device for habit formation limiting arm movement over a predetermined range of motion providing a basketball shooting training device 10 which is attached to either the forearm or the upper arm of a basketball player to prevent the player from bending his or her arm to an selected angle.

Figure 6:
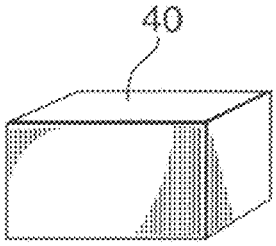
FIG. 6 is a side perspective view of a rectangular, ovoid, roll, or cube shaped compressible spacer means.
Figure 7:
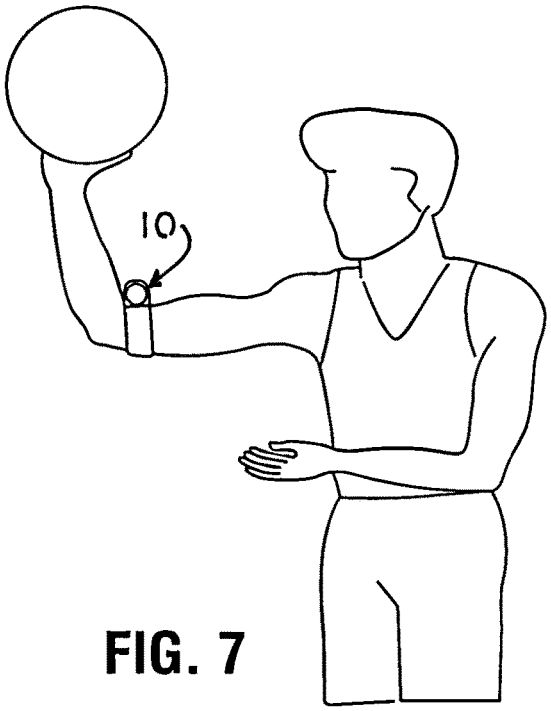
FIG. 7 is a front view of a player wearing the basketball shooting training device with the elbow bent and the forearm pulled back toward the upper arm showing the orientation of the compressible spacer means defining a ball resting opposite the player's elbow.
Figure 8:
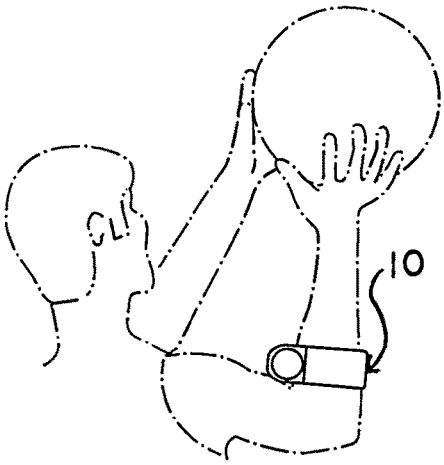
FIG. 8 is a rear right side view of a player shown in phantom lines wearing the basketball shooting training device wherein the spacer means is contacting the forearm and upper arm of the player and the ball is lifted to the shooting position.
Figure 9:
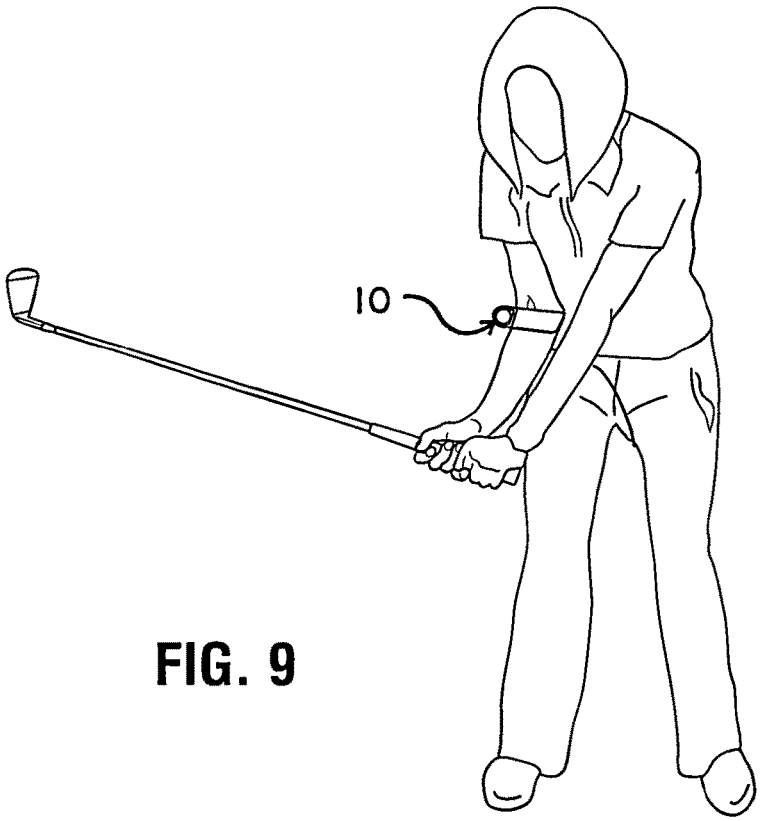
FIG. 9 is a front view of a golfer wearing the basketball shooting training device worn by a golfer to limit movement of the forearm and upper arm preventing bending of the arm during the back swing.
Figure 10:
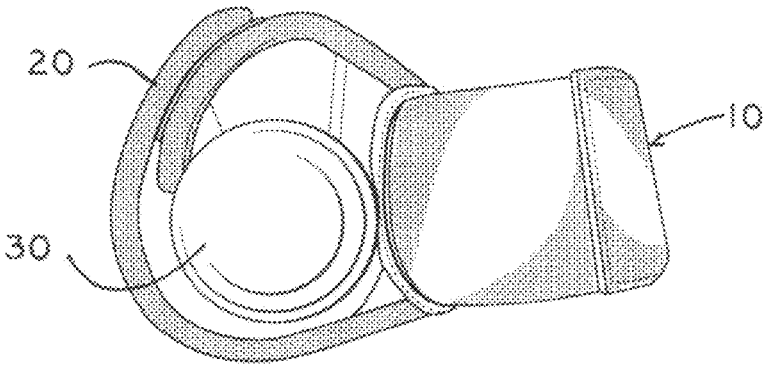
FIG. 10 is a cutaway end view of the basketball shooting training device of FIG. 1 showing the compressible spacer means disposed within the pocket means removably affixed to the forearm strap.
Figure 11:
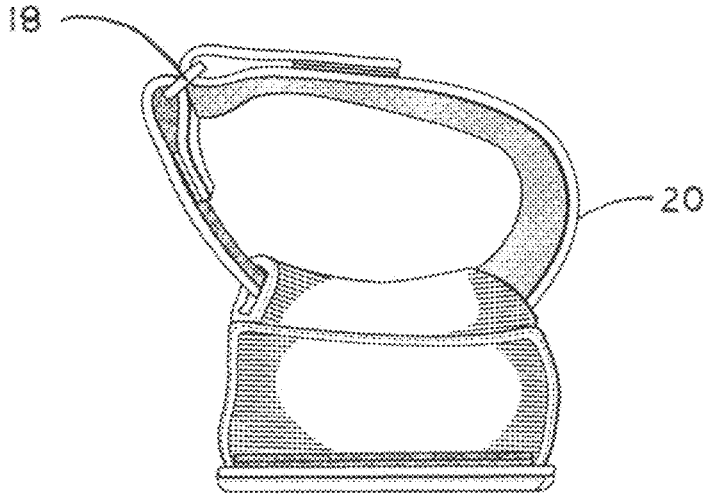
FIG. 11 is an end view of the basketball shooting training device of FIG. 1 showing the fastening means as D ring and hook and loop fasteners with the strap extending through a loop formed at a base of the pocket.
Figure 12:
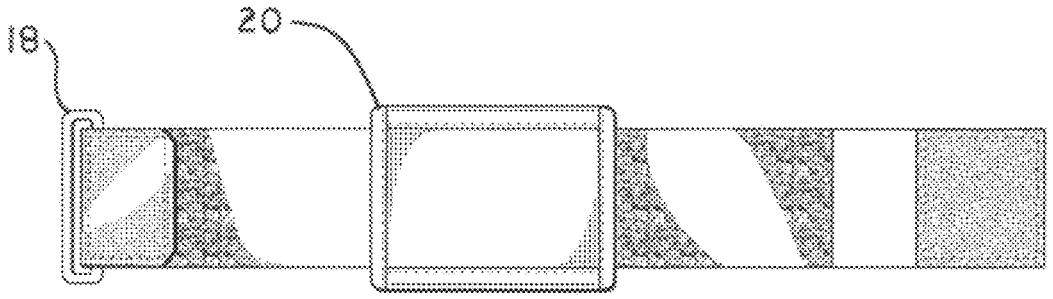
FIG. 12 is a top perspective view of the basketball shooting training device with the attachment strap unrolled and showing the generally medial positioned pocket affixed thereto.
Figure 13:
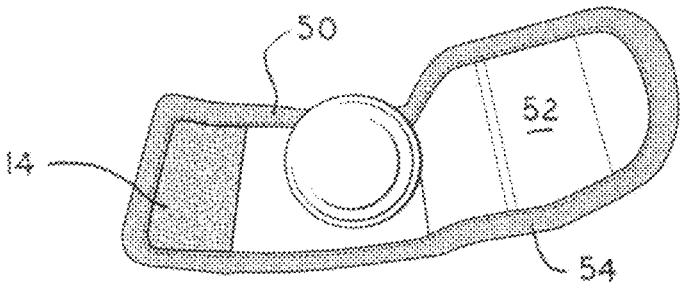
FIG. 13 is a perspective view of the spacer means (ball) and the device pocket device open showing the wider center portion and narrower side edges forming a pocket.
Figure 14:
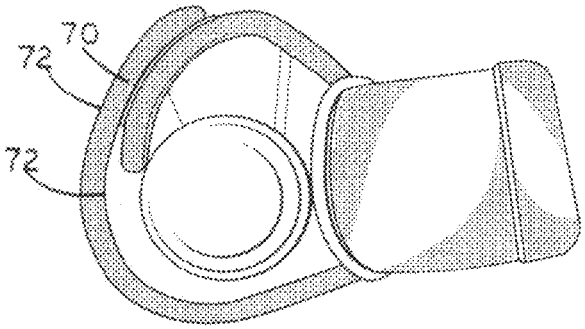
FIG. 14 is a cutaway perspective side view showing a double backed neoprene or foam rubber material sandwiched between two protective fabric outer layers.
Figure 15:
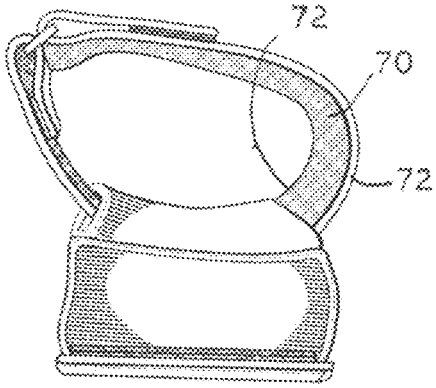
FIG. 15 is a cutaway end view of the basketball shooting training device of FIG. 1 showing the fastening means as D ring and hook and loop fasteners with the strap extending through a loop formed at a base of the pocket and showing a double backed neoprene or foam rubber material sandwiched between two protective fabric outer layers.
Figure 16:
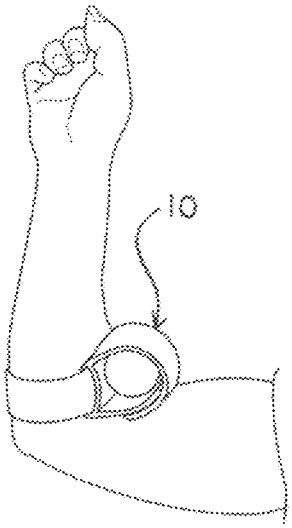
FIG. 16 is a side perspective view of a players forearm raised in a vertical position with the basketball shooting training device attached at the lower forearm at the inside of the elbow.
Figure 17:
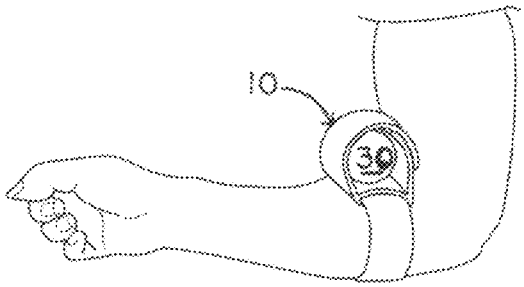
FIG. 17 is a front view of a players forearm lowered in a horizontal position with the basketball shooting training device attached at the lower forearm at the inside of the elbow shown in the lowered ball dribbling position.
Figure 18:
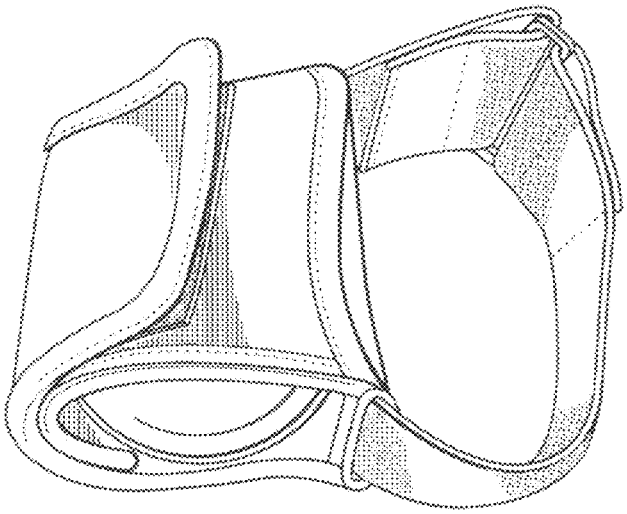
FIG. 18 is a front view of the training device.

As shown in the figures, an attachment strap 12 is fastened around a selected position on the arm of a player. Attached to an upper surface of the strap 12 is a pocket 20 into which has been fastened a spacer means 30 which is preferably a ball such as a tennis ball. An alternative embodiment of the training device includes a rectangular or cube shaped spacer means 40 such as that shown in FIG. 6. With the training device 10 attached to either the forearm 6 or the upper arm 4 at a position near the inside of the elbow, the player is prevented from bending the arm to a selected limiting angle. The position of the training device on the arm determines the selected limiting angle. The preferred limiting angle is 90° but other angles are possible according to the placement of the training device 10.

Figure 1:
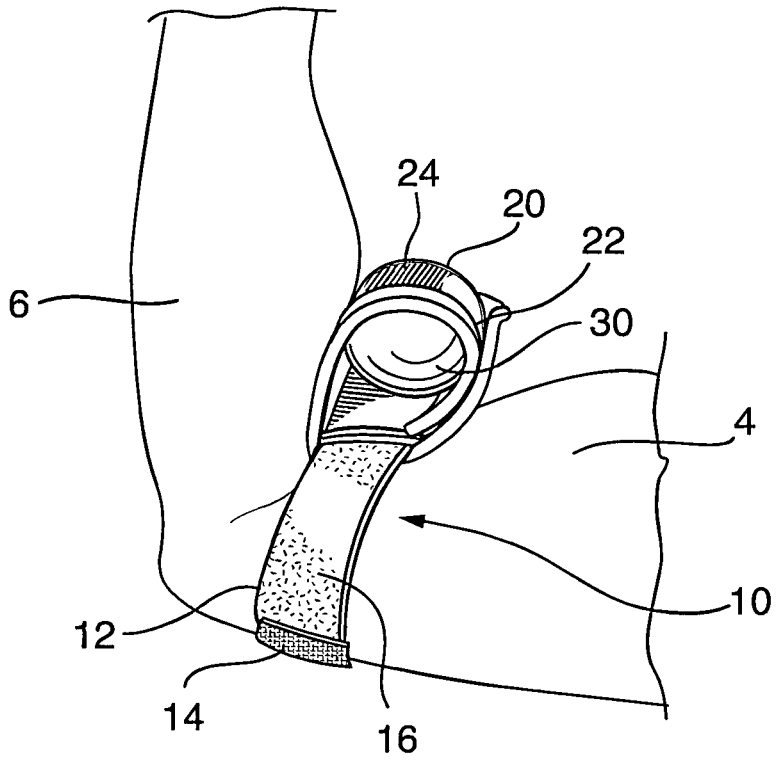
FIG. 1 is a side view of the basketball shooting training device attached to the forearm of a player.
Figure 2:
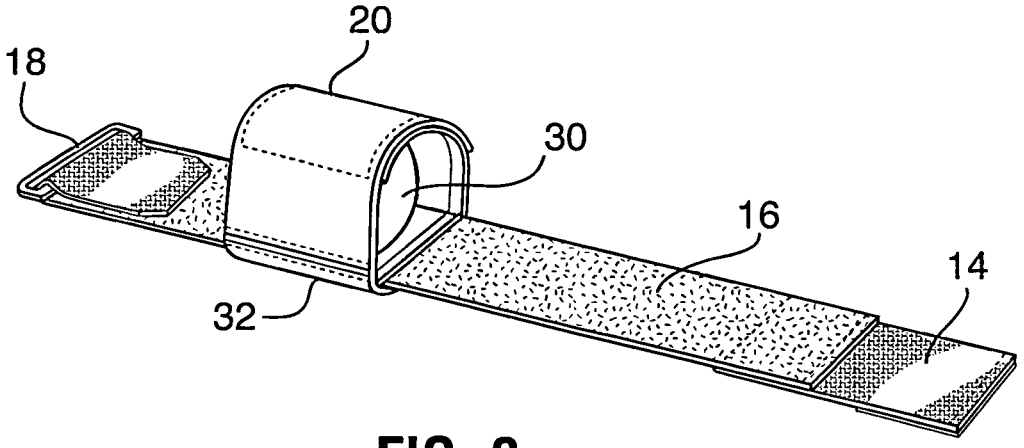
FIG. 2 is a side perspective view of the basketball shooting training device with the removable attachment strap unrolled and lying flat showing the D-ring fastening means, hook and loop fasteners, pocket means and spacer means comprising a compressible air filled ball of a selected size therein.
Figure 3:
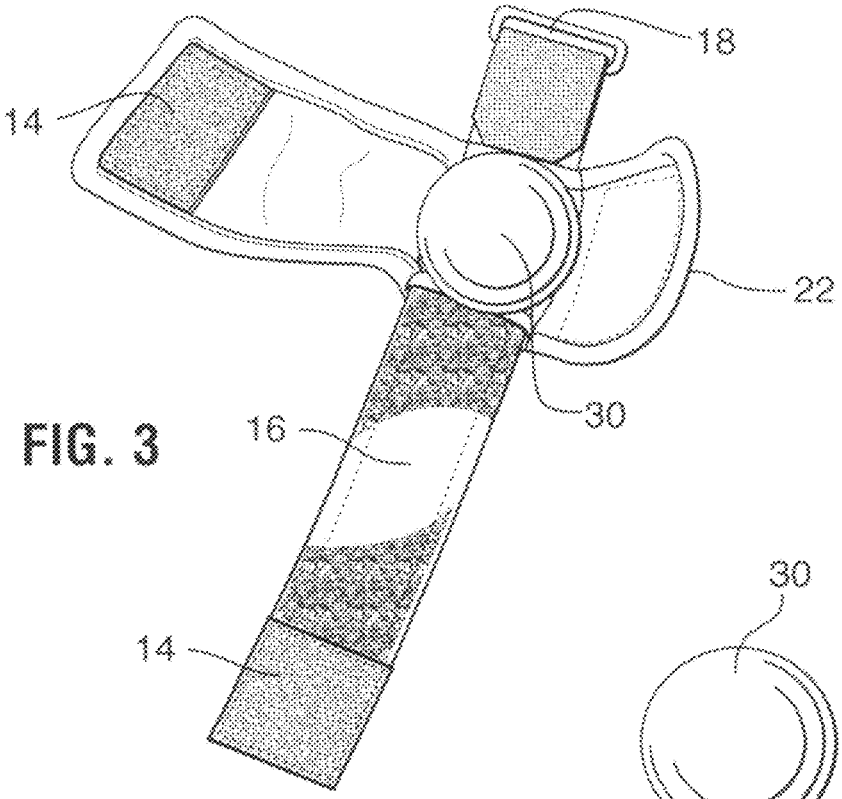
FIG. 3 is a top perspective view of the basketball shooting training device with the attachment strap unrolled, with the spacer means showing the ball as a spacer means with the pocket device open showing the hook and loop fasteners on the inner surface of one end of the pocket strap for cooperative engagement with hook and loop fasteners on the mating surface of the distal flap adjacent the portion of the strap surrounding the compressible ball lying in the pocket.
Figure 5:
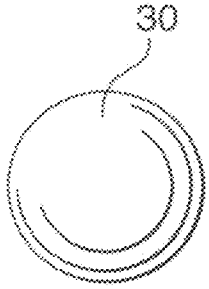
FIG. 5 is a side view of a compressible ball which is used as a spacer means.
Figure 4:
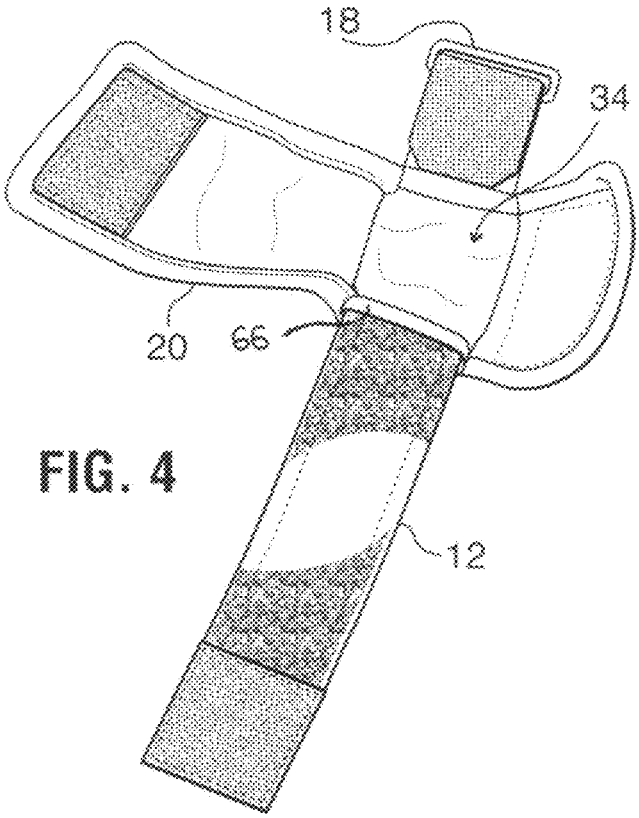
FIG. 4 is a top perspective view of the basketball shooting training device of FIG. 3 showing the attachment strap unrolled and with the spacer means pocket device in an open position.

As shown in FIG. 2, the training device preferably includes attachment strap 12 including an a buckle 18 comprising a rectangular loop or D ring at one end, and hook and loop fastening means at the opposite end of the attachment strap 12. The strap 12 is 12 to 20 inches long, about one and one-half to three inches wide and preferably un-stretchable. It can be seen that hook material covers the top surface of the strap 12 near the end for a length of about two inches and loop material covers the top surface of the strap 12 from about two inches from the end to about six or seven inches from the buckle 18 at the other end. The strap 12 is device on and wrapped around the arm with the hook and loop side facing outwards. The hook and/or loop portion 14 is fed through the buckle 18, the strap 12 is drawn tight and the hook and/or loop portion 14 of the strap 12 is then pressed against the hook and/or loop portion 16 of the strap 12.

A spacer means pocket 20 comprises a pocket strap 21 attached to the same side of the strap 12 as the hook and loop fasteners and at a right angle to the attachment strap. The pocket strap 21 is three to five inches wide, ten to twelve inches long, and is preferably sewn with stitching 32 to the attachment strap 12. The pocket strap 21 includes hook and loop fasteners attached at respective ends of the strap 21. Other means of attaching the pocket strap 21 to the attachment strap 12 include adhesives, rivets and lacing, or a loop 34 extending between a layer of material 66 holding the spacer means and the outer strap covering for sliding cooperative engagement with the removable strap 12.

At one end of the bottom surface of the strap 21 is the hook material 24 on the top side. At the other end of the strap 21 is the loop material 22 on the bottom side. With this configuration, the spacer means 30 is placed on the pocket strap 21 over the area where the pocket strap 21 is attached to the attachment strap 12. The end of the pocket strap 21 with the loop material 22 is brought up over the surface of the spacer means 30 and the other end of the pocket strap with the hook material is brought over the other side of the spacer means 30, thus covering the spacer means. The hook material 24 is pressed onto the loop material 22, thereby fastening the pocket 20 tightly closed. The spacer means is preferably a resilient ball 30 such as a tennis ball. Alternatively, the spacer means is a resilient block 40 which is rectangular or cubic in shape.

It is understood that hook material and loop material may be interchanged with one another since interchanging of these two still results in two surfaces which will be removably attach to one another. It is preferable, however, that the resulting attachment of the two pieces of material does not result in hook material facing outwards, which would then cause catching of debris and uncomfortable scratching of the hook material against a player's skin.

Preferred materials for the attachment strap and the pocket strap include a nylon, polypropylene or other synthetic woven material, and may include lining material such as foam rubber, neoprene, vinyl, leather or the like.

Figure 21:
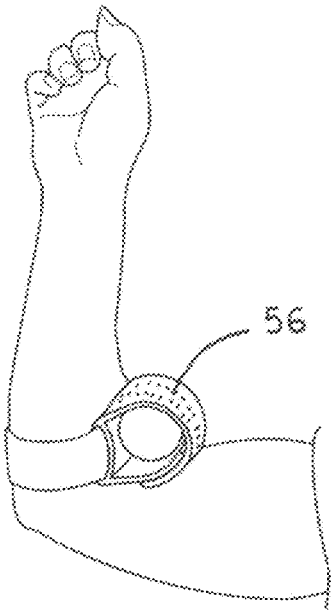
FIG. 21 is a side view of a players forearm lowered in a horizontal position with the basketball shooting training device attached at the lower forearm at the inside of the elbow wherein the pocket comprises a porous material.
Figure 22:
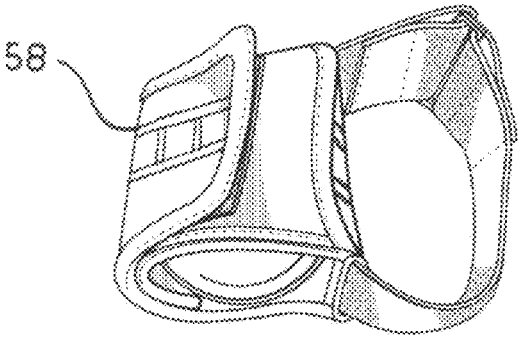
FIG. 22 is a front perspective view of the basketball shooting training device with a spacer means (ball) held tightly with hook and loop material with the belt fastened.
Figure 23:
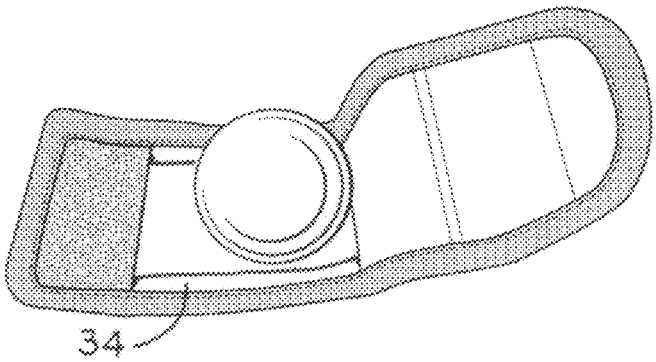
FIG. 23 is a perspective view of the spacer means (ball) and the device pocket device open showing the wider center portion and narrower side edges forming a pocket.

As shown in FIG. 21, the strap and/or pocket can be formed of porous, breathable material 56. FIG. 22 shows the pocket material comprising strips of material 58 which may be elastomeric to stretch around the compressible spacer means and hold it into position.

A preferred material of composition for the strap and pocket of the present invention is a neoprene or foam rubber material 70 sandwiched between thin sheets of tougher material such as nylon or lycra/spandex material ranging from 1 mm to 8 mm in thickness. The double backed neoprene or form rubber material sandwiched between two protective fabric outer layers 72 greatly increase the tear-resistance of the material while maximizing the softness, compressibility and flexibility of the material.

Figure 19:
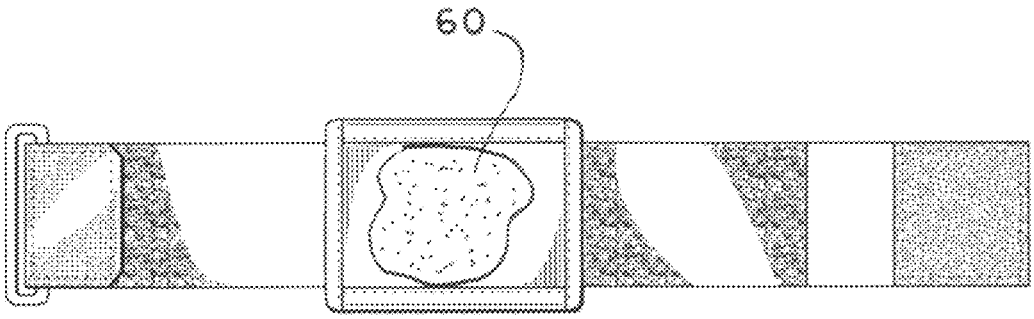
FIG. 19 is a top perspective view of the basketball shooting training device with the attachment strap unrolled and showing the generally medial positioned pocket affixed thereto and a bag of viscous silicone material contained within the pocket.
Figure 20:
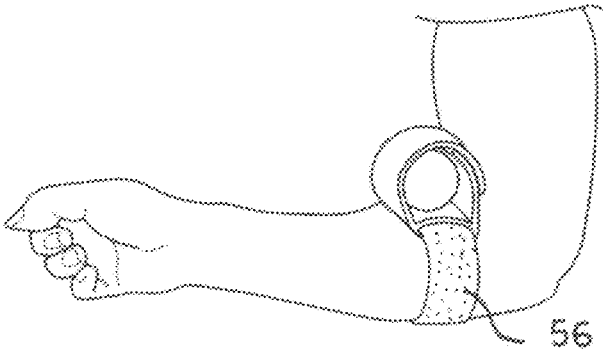
FIG. 20 is a side perspective view of a players forearm raised in a vertical position with the basketball shooting training device attached at the lower forearm at the inside of the elbow wherein the strap comprises a porous material.

More particularly, the basketball shooting training device comprises or consists of an removable and adjustable strap for securing to the forearm of user. Pocket means attaches to the adjustable strap, the pocket means is positioned between a forearm portion of the user and an upper arm portion of the user adjacent the user's elbow. A spacer means of a selected size and shape disposed within the pocket means. The basketball shooting training device restricts the angle to which the forearm and the upper arm can be bent at the elbow on backward movement of the arm of the user. The pocket means comprises at least a strip of material selected from the group consisting of a nylon woven material, a polypropylene woven material, a synthetic woven materials, a foam rubber, a neoprene, a vinyl, and a leather. The spacer means comprises a compressible material such as a fluid or air filled ball or bladder. As shown in FIG. 19, the compressible material is selected from the group consisting of an blastomeric material, a polymer, a container or bag of viscoelastic liquid silicone 60, a non-Newtonian fluid, a viscous liquid, a rubber material, a fibrous material, a tennis ball, a racquet ball, and combinations thereof. The removable and adjustable strap includes means of fastening selected from the group consisting of at least a section of hook and loop fasteners, a buckle, a stretchable material, a section of stretchable material, buttons, snaps, adhesive material, and combinations thereof. The pocket comprises a strap sized and shaped for cooperative engagement with the spacer means, the strap having a first edge portion 50 and a second edge portion 54 of a slightly smaller diameter that a wider center portion 52 defining the pocket. The pocket comprises releaseably retains the spacer means therein, the pocket including means of fastening selected from the group consisting of at least a section of hook and loop fasteners, a buckle, a stretchable material, a section of stretchable material, buttons, snaps, adhesive material, and combinations thereof. The pocket including means of orientation comprising at least one opening normal to strap defining a loop for cooperative engagement with the strap. The removable and adjustable strap further comprises a D-ring attached to a distal end of the strap by attachment means selected from the group consisting of sewn stitches and hook and loop material for cooperative engagement with an opposing end portion of the removable and adjustable strap. In one preferred embodiment, the removable and adjustable strap and pocket means comprise a neoprene or foam rubber material sandwiched between a pair of thin sheets of synthetic material selected from the group consisting of a polyester, a nylon, a lycra/spandex material and combinations thereon ranging from 1 mm to 8 mm in thickness.

In accordance with the present invention, there is provided a training device for habit formation limiting limb movement over a predetermined range of motion providing a basketball shooting training device 10 which is attached to either the forearm or the upper arm of a basketball player to prevent the player from bending his or her arm to an selected angle.

The foregoing detailed description is given primarily for clearness of understanding and no unnecessary limitations are to be understood therefrom, for modification will become obvious to those skilled in the art upon reading this disclosure and may be made upon departing from the spirit of the invention and scope of the appended claims. Accordingly, this invention is not intended to be limited by the specific exemplification presented herein above. Rather, what is intended to be covered is within the spirit and scope of the appended claims.

I claim:

1. A basketball shooting training device consisting of:

a removable and adjustable arm attachment strap;

said arm attachment strap including hook and loop material on a selected surface of a first distal end;

said arm attachment strap including hook and loop material on a selected surface of a second opposing distal end for cooperatively engaging said hook and loop material on said first distal end;

said first distal end looping through a first loop and folding over in adjustable cooperative engagement with itself;

said second distal end looping through a second loop and folding over in adjustable cooperative engagement with itself;

said arm attachment strap formed from non-stretchable woven material selected from the group consisting of a nylon, a polypropylene and a synthetic material a pocket strap including a loop immovably affixed in a selected location transverse to said adjustable arm attachment strap, said pocket strap including hook and loop material on a selected surface of a first distal end cooperatively engaging corresponding book and loop material on a selected surface of a second opposing distal end, said first distal end of said pocket strap releasably and adjustably engaging said second opposing distal end of said pocket strap forming a concave pocket therebetween;

said first distal end and said second distal end of said pocket strap having a wider width than a portion of said pocket strap affixed to said adjustable arm attachment strap, said first distal end and said second distal end adapted for overlapping alignment forming a pocket including outer edges covering a portion of a blocking device;

said pocket surrounding and holding said blocking device of a selected size therein, said pocket surrounding a center portion of said blocking device and said pocket including outer edges extending past said ball;

said pocket strap consisting of a stretchable material selected from the group consisting of a foam rubber, a neoprene, a vinyl, a leather and combinations thereof;

said arm attachment strap positionable for surrounding a forearm of a user with said pocket positionable between an upper arm portion of said user adjacent an inner portion of an elbow whereby inward pivotal movement of said elbow is limited to a predetermined range of motion of greater than 90 degrees.

2. The basketball shooting training device of claim 1 wherein said pocket strap includes a lining in said pocket.

3. A basketball shooting training device consisting of:

a removable and adjustable arm attachment strap;

said arm attachment strap including hook and loop material on a selected surface of a first distal end;

said arm attachment strap including hook and loop material on a selected surface of a second opposing distal end for cooperatively engaging said hook and loop material on said first distal end;

said first distal end looping through a first ring and folding over in adjustable cooperative engagement with itself;

said second distal end looping through a second ring and folding over in adjustable cooperative engagement with itself;

said arm attachment strap formed from non-stretchable material selected from the group consisting of a woven material;

a pocket strap including a loop for immovably affixed in a selected position transverse to said adjustable arm attachment strap, said pocket strap including hook and loop material on a selected surface of a first distal end cooperatively engaging corresponding hook and loop material on a selected surface of a second opposing distal end, said first distal end of said pocket strap releasably and adjustably engaging said second opposing distal end of said pocket strap forming a pocket therebetween;

said first distal end and said second distal end of said pocket strap having a wider width than a portion of said pocket strap affixed to said adjustable arm attachment strap, said first distal end and said second distal end adapted for overlapping alignment forming a concave pocket including outer edges covering a portion of a resilient ball;

said pocket surrounding and holding a compressible ball of a selected size therein, said concave pocket surrounding a center portion of said compressible ball and said concave pocket including outer edges extending past said compressible ball;

said pocket strap consisting of a stretchable material whereby said outer edges of said concave pocket surrounding said center portion of said compressible ball;

said arm attachment strap positionable for surrounding a forearm of a user with said pocket positionable between an upper arm portion of said user adjacent an inner portion of an elbow whereby inward pivotal movement of said elbow is limited to a predetermined range of motion of greater than 90 degrees.

4. The basketball shooting training device of claim 3 wherein said woven nonstretchable material is selected from the group consisting of a nylon, a polypropylene and a synthetic woven material.

5. The basketball shooting training device of claim 3 wherein said pocket strap consists of a stretchable material selected from the group consisting of a foam rubber, a neoprene, a vinyl, and a leather.

6. The basketball shooting training device of claim 3 wherein said pocket strap includes a lining in said pocket.

7. The basketball shooting training device of claim 3 wherein said woven nonstretchable material is selected from the group consisting of a nylon, a polypropylene and a synthetic woven material.

8. The basketball shooting training device of claim 3 wherein said pocket strap consists of a stretchable material selected from the group consisting of a foam rubber, a neoprene, a vinyl, and a leather.

9. The basketball shooting training device of claim 3 wherein said pocket strap includes a lining in said pocket.

10. A basketball shooting training device consisting of:

a removable and adjustable arm attachment strap;

said arm attachment strap including hook and loop material on a selected surface of a first distal end;

said arm attachment strap including hook and loop material on a selected surface of a second opposing distal end;

said first distal end folding over in adjustable cooperative engagement with itself;

said second distal end looping folding over in adjustable cooperative engagement with itself;

said arm attachment strap formed from non-stretchable material selected from the group consisting of a woven material;

a pocket strap including a loop for immovably affixed in a selected position transverse to said adjustable arm attachment strap, said pocket strap including hook and loop material on a selected surface of a first distal end cooperatively engaging corresponding hook and loop material on a selected surface of a second opposing distal end, said first distal end of said pocket strap releasably and adjustably engaging said second opposing distal end of said pocket strap forming a pocket therebetween;

said first distal end and said second distal end of said pocket strap having a wider width than a portion of said pocket strap affixed to said adjustable arm attachment strap, said first distal end and said second distal end adapted for overlapping alignment forming a concave pocket;

said concave pocket surrounding and holding a resilient ball of a selected size therein, said concave pocket surrounding a center portion of said resilient ball and said concave pocket including outer edges extending past and covering a portion of said ball;

said concave pocket consisting of a stretchable compressible material whereby said outer edges surrounding and partially encloses said center portion of said ball;

said arm attachment strap positionable for surrounding a forearm of a user with said pocket positionable between an upper arm portion of said user adjacent an inner portion of an elbow whereby inward pivotal movement of said elbow is limited to a predetermined range of motion of greater than 90 degrees.

11. The basketball shooting training device of claim 10, said first distal end and said second distal end looping through a ring and folding back over in adjustable cooperative engagement with itself.

12. The basketball shooting training device of claim 10, wherein said stretchable compressible material of said pocket comprises neoprene.

* * * * *